US006418586B2

(12) United States Patent
Fulghum

(10) Patent No.: US 6,418,586 B2
(45) Date of Patent: Jul. 16, 2002

(54) LIQUID EXTRACTION MACHINE

(75) Inventor: Trent A. Fulghum, Fayetteville, AR (US)

(73) Assignee: Alto U.S., Inc., Chesterfield, MO (US)

( * ) Notice: Subject to any disclaimer, the term of this patent is extended or adjusted under 35 U.S.C. 154(b) by 0 days.

(21) Appl. No.: 09/973,454

(22) Filed: Oct. 9, 2001

Related U.S. Application Data

(63) Continuation-in-part of application No. 09/496,395, filed on Feb. 2, 2000.
(60) Provisional application No. 60/239,137, filed on Oct. 10, 2000.

(51) Int. Cl.[7] ..... A47C 11/30
(52) U.S. Cl. ..... 15/320
(58) Field of Search ..... 15/320

(56) References Cited

U.S. PATENT DOCUMENTS

| | | | | |
|---|---|---|---|---|
| 3,959,844 A | | 6/1976 | Cyphert | |
| 4,014,067 A | | 3/1977 | Bates | |
| 4,182,001 A | | 1/1980 | Krause | |
| 4,194,262 A | | 3/1980 | Finley et al. | |
| 4,756,048 A | | 7/1988 | Kauffeldt et al. | |
| 4,956,891 A | | 9/1990 | Wulff | |
| 5,163,203 A | | 11/1992 | Tanasescu et al. | |
| 5,180,439 A | | 1/1993 | Allison | |
| 5,659,918 A | * | 8/1997 | Anthony et al. | 15/320 |
| 5,813,086 A | * | 9/1998 | Ueno et al. | 15/320 |
| 5,836,045 A | * | 11/1998 | Anthony et al. | 15/320 |
| 5,933,913 A | | 8/1999 | Wright et al. | |
| 5,937,475 A | | 8/1999 | Kasen et al. | |
| 6,105,203 A | | 8/2000 | Hueppi et al. | |

* cited by examiner

*Primary Examiner*—Philippe Derakshani
(74) *Attorney, Agent, or Firm*—Senniger, Powers, Leavitt & Roedel

(57) ABSTRACT

An extraction machine for cleaning a floor surface, such as carpeting, has a cleaning solution dispenser capable of dispensing a chemical cleaning agent onto the floor surface, and a source of chemical cleaning agent carried onboard the extraction machine and defining an interior space for holding chemical cleaning agent. The container has an opening and a closure for the opening, with the closure having a passage extending therethrough in fluid communication with the interior space of the container. A chemical delivery line provides fluid communication between the passage and the cleaning solution dispenser for delivering chemical cleaning agent from the container to the cleaning solution dispenser. A metering device is disposed generally adjacent the container closure in fluid communication with the passage for metering the flow of chemical cleaning agent from the source of cleaning agent.

13 Claims, 6 Drawing Sheets

LIQUID EXTRACTION MACHINE

REFERENCE TO RELATED APPLICATIONS

This application is a continuation-in-part of U.S. patent application Ser. No. 09/496,395, filed Feb. 2, 2000, and claims the benefit of U.S. Provisional Application No. 60/239,137, filed Oct. 10, 2000, both of which are incorporated herein by reference.

BACKGROUND OF THE INVENTION

This invention relates generally to a floor surface treatment machine used for treating floor surfaces, and more particularly to an extraction machine used for cleaning floor surfaces with a cleaning liquid and then extracting the dirty solution from the floor, and even more particularly to such an extraction machine having an improved cleaning system.

In extraction machines of conventional design, a solution tank contained within the machine housing releases a cleaning solution onto the surface to be cleaned, such as a carpet. The cleaning solution is a pre-mixed solution comprised of water and a liquid or powder cleaning agent. The solution is sprayed onto the carpet through one or more spray nozzles located in front of a scrub brush of the extraction machine. The scrub brush, driven by a brush motor, works the cleaning solution into the carpet to effect cleaning of the carpet, leaving a dirty solution within the carpet.

During operation, the machine is self-propelled or moved manually to pass over the dirty solution so that a vacuum shoe attached to the machine remains in contact with the carpet and collects the dirty solution. A vacuum pump driven by a vacuum motor creates a vacuum within a recovery tank which communicates with the shoe by means of a recovery line extending between the recovery tank and the shoe. Suction created by the vacuum pump extracts the dirty cleaning solution from the carpet, resulting in a cleaned carpet. The dirty solution is suctioned through the shoe and recovery line into the recovery tank carried by the machine.

It is also known to provide an additional set of spray nozzles intermediate the brush and the vacuum shoe to dispense additional cleaning solution, drawn from the same solution tank, onto the carpet to rinse the carpet prior to the dirty solution being suctioned from the floor.

One drawback associated with the conventional extraction machines described above is that a residue of cleaning chemical often remains in the carpet after cleaning. This typically results in quicker re-soiling of the carpet. Another drawback is that the pre-mixed cleaning solution in the tank must be drained from the solution tank when the extraction machine is being stored, such as when cleaning for the day is completed. This prevents settling or separation of the cleaning chemical and water in the tank. However, this also results in wasted solution where the contents of the tank are not completely used during cleaning.

SUMMARY OF THE INVENTION

Among the several objects of this invention may be noted the provision of an extraction machine with an improved cleaning system which leaves carpets cleaner than conventional extraction machines; the provision of such an extraction machine which leaves less cleaning chemical residue in the carpet after cleaning; the provision of such an extraction machine which reduces solution waste; and the provision of such an improved cleaning system which can be incorporated into existing extraction machines.

In general, an extraction machine of the present invention for cleaning a floor surface, such as carpeting, comprises a cleaning solution dispenser capable of dispensing a chemical cleaning agent onto the surface being cleaned. A container is carried onboard the extraction machine and defines an interior space for holding a supply of the chemical cleaning agent. The container has an opening and a closure for the opening, with the closure having a passage extending therethrough in fluid communication with the interior space of the container. A chemical delivery line provides fluid communication between the passage of the container closure and the cleaning solution dispenser for delivering chemical cleaning agent from the interior space of the container to the cleaning solution dispenser. A metering device is disposed generally adjacent the container closure in fluid communication with the passage of the closure for metering the flow of chemical cleaning agent from the source of cleaning agent.

In another embodiment, the extraction machine comprises a cleaning solution dispenser capable of dispensing a chemical cleaning agent onto the surface being cleaned. A source of cleaning agent is carried onboard the extraction machine and a chemical delivery line provides fluid communication between the source of chemical cleaning agent and the cleaning solution dispenser for delivering chemical cleaning agent from the source of cleaning agent to the cleaning solution dispenser. A source of diluting solution is provided for delivering diluting solution to the cleaning solution dispenser, and is in fluid communication with the chemical delivery line to permit admixture of the chemical cleaning agent and the diluting solution during flow to cleaning solution dispenser to form a cleaning solution for dispensing onto the floor surface by the cleaning solution dispenser. An injection device is in fluid communication with the source of chemical cleaning agent for injecting chemical cleaning agent from the source of cleaning agent into admixing relationship with the diluting solution to facilitate admixture of the cleaning agent with the diluting solution. A metering device for metering the flow of chemical cleaning agent from the source of cleaning agent is disposed substantially upstream of the injection device.

Other objects and features will become in part apparent and in part pointed out hereinafter.

BRIEF DESCRIPTION OF THE DRAWINGS

Corresponding parts are designated by corresponding reference characters and numerals throughout the several views of the drawings.

DESCRIPTION OF THE PREFERRED EMBODIMENT

Figure 1:
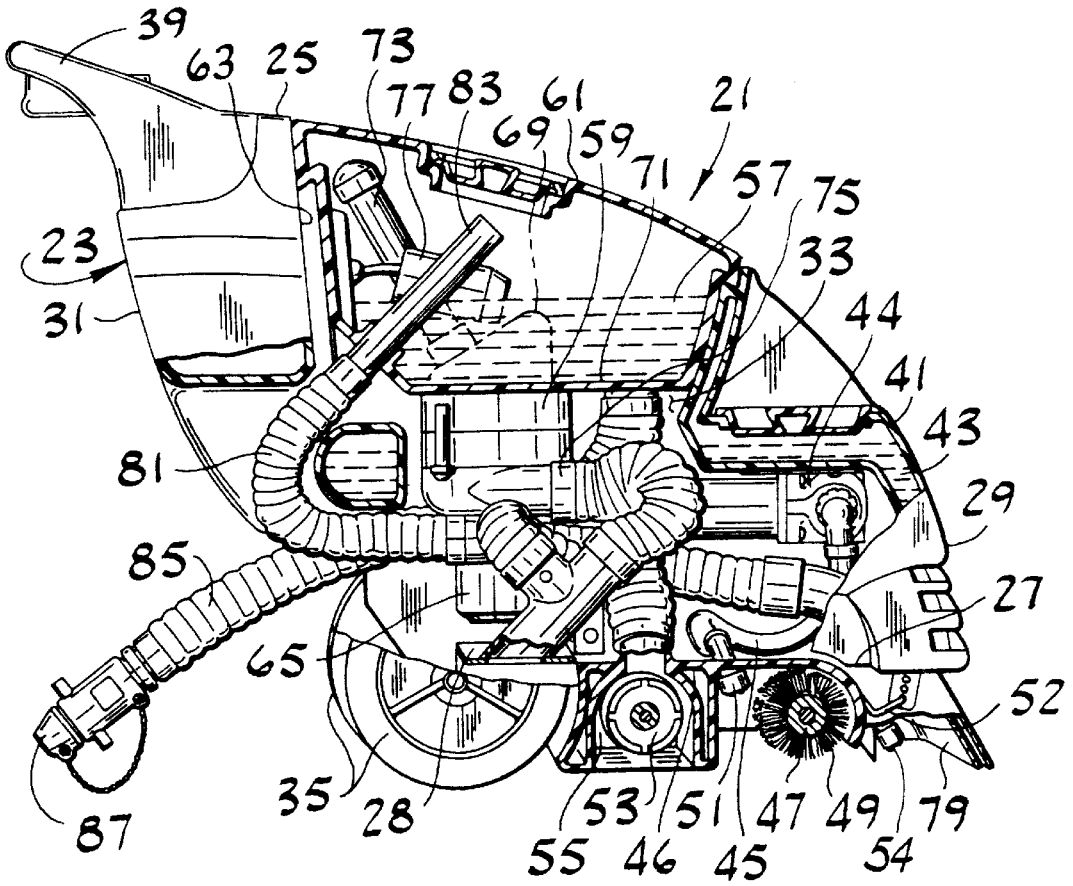
FIG. 1 is a side view of a conventional extraction machine of this invention with parts removed to show details.

Referring now to FIG. 1, a conventional extraction machine for cleaning floor surfaces, such as carpeting, is indicated in its entirety by the reference numeral 21. The extraction machine comprises a main housing, indicated generally at 23, mounted on wheels 35 so the machine can readily be moved by an operator. The wheels may also be driven by a motor (not shown) to self-propel the extraction machine. The machine 21 shown in FIG. 1 is propelled from right to left. A handle 39 mounted at the rear of the machine 21 provides the operator with a convenient means for guiding and maneuvering the extraction machine during operation. Suitable controls (not shown) on the handle 39 are provided for activating various operating components of the machine.

The main housing 23 has a top wall 25, a bottom wall 27, a front wall 29, a rear wall 31 and side walls (not shown), portions of which define a solution tank 41. The main housing 23 also defines a cavity 33 which contains the operating components of the extraction machine 21. The bottom wall 27 of the main housing 23 is partially defined by plates 28 (one of which is shown in FIG. 1). The plates 28 are spaced apart in close relationship with each other to define interstices (not shown) between the plates. The interstices allow ambient air external to the main housing 23 to enter the cavity 33.

The solution tank 41 holds a supply of cleaning solution 43 for cleaning the floor surface. A solution pump 44 communicates with the solution tank 41 to deliver cleaning solution from the tank to a feed line 45. A brush housing 46 is attached to the underside of the main housing 23. A locator pin 52 is provided for releasably securing the brush housing 46 at a predetermined height above the floor and for adjusting the height of the brush housing depending on the depth of the carpet to be cleaned. The feed line 45 extends through the brush housing 23 to a manifold (not shown) to direct cleaning solution to one or more spray nozzles 51 spaced laterally across the bottom of the brush housing for delivering cleaning solution onto the surface to be cleaned. A second set of nozzles 54 is located beneath the front of the main housing 23 for directing additional cleaning solution onto the surface to be cleaned.

A rotary scrub brush 47 is mounted for rotation within the brush housing 46 between the first and second sets of nozzles 51, 54. The brush 47 has bristles 49 which contact the surface to be cleaned and is located close to the spray nozzles 54 to encourage interaction between the scrub brush and the cleaning solution 43. The scrub brush 47 is driven by a brush motor 53 located in a compartment 55 in the brush housing 46 to effect a scrubbing action with the cleaning solution 43 to remove dirt on or within the floor surface. As dirt is removed from the surface, it attaches itself to the cleaning solution 43 to leave a dirty solution 57 on the surface of the floor. Additional cleaning solution is dispensed onto the surface through the second set of nozzles 54 after the brush has passed over a particular portion of the surface to further attract dirt prior to suctioning of the dirty solution from the surface.

A vacuum pump 59 is mounted within the cavity 33 directly below a solution recovery tank 61 seated in an opening 63 in the top wall 25 of the housing 23. The vacuum pump 59 and an associated suction fan (not shown) are driven by a vacuum motor 65, such as an electric drive motor, mounted beneath the pump. The vacuum pump 59 has an intake (not shown) which communicates with the inside of a hollow air cap 69 sealingly attached to or integrally formed with the bottom wall of the recovery tank. A suction pipe 73 extends up from this cap 69 to a location adjacent the top of the recovery tank 61. The arrangement is such that operation of the vacuum pump 59 and associated suction fan draws air from the recovery tank to create a vacuum in the tank. The vacuum pump 59 has an exhaust 75 through which air from the suction fan is exhausted. A liquid level sensor 77 is provided for sensing the level of dirty solution 57 within the recovery tank 61. This sensor 77 is operable to shut off the extraction machine 21 before the solution level reaches the upper end of the suction pipe 73.

A vacuum shoe 79 is attached to the underside of the main housing 23 and extends between the housing and the floor surface so that the shoe and wheels 35 combine to support the extraction machine 21 in an upright position. The shoe 79 has a centrally located opening (not shown) extending upwardly therethrough. This opening is connected by means of a flexible recovery line or hose 81 to a rigid fill tube 83 extending up into the recovery tank 61, the upper end of the tube being at a level higher than that of the aforementioned level sensor 77. As the shoe 79 passes over the surface being cleaned, the vacuum in the recovery tank 61 is sufficient to extract the dirty solution 57 from the floor surface through the opening in the shoe and up through the hose 81 and the fill tube 83 for delivery to the recovery tank 61. A drain line 85 with a closure 87 is provided for draining dirty solution 57 from the recovery tank 61 as needed.

Figure 2:
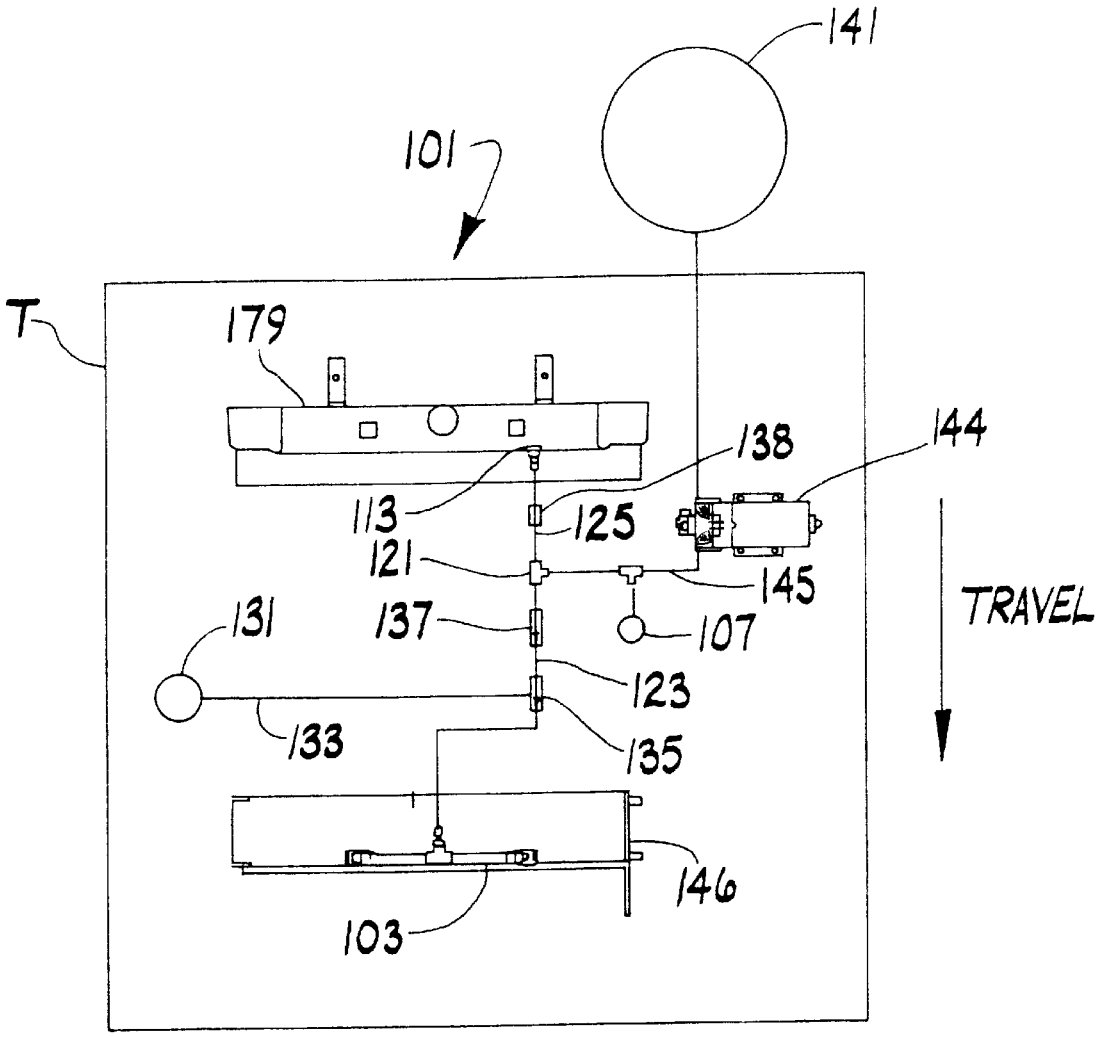
FIG. 2 is a schematic top view of a cleaning system of the present invention shown mounted on a test fixture.
Figure 3:
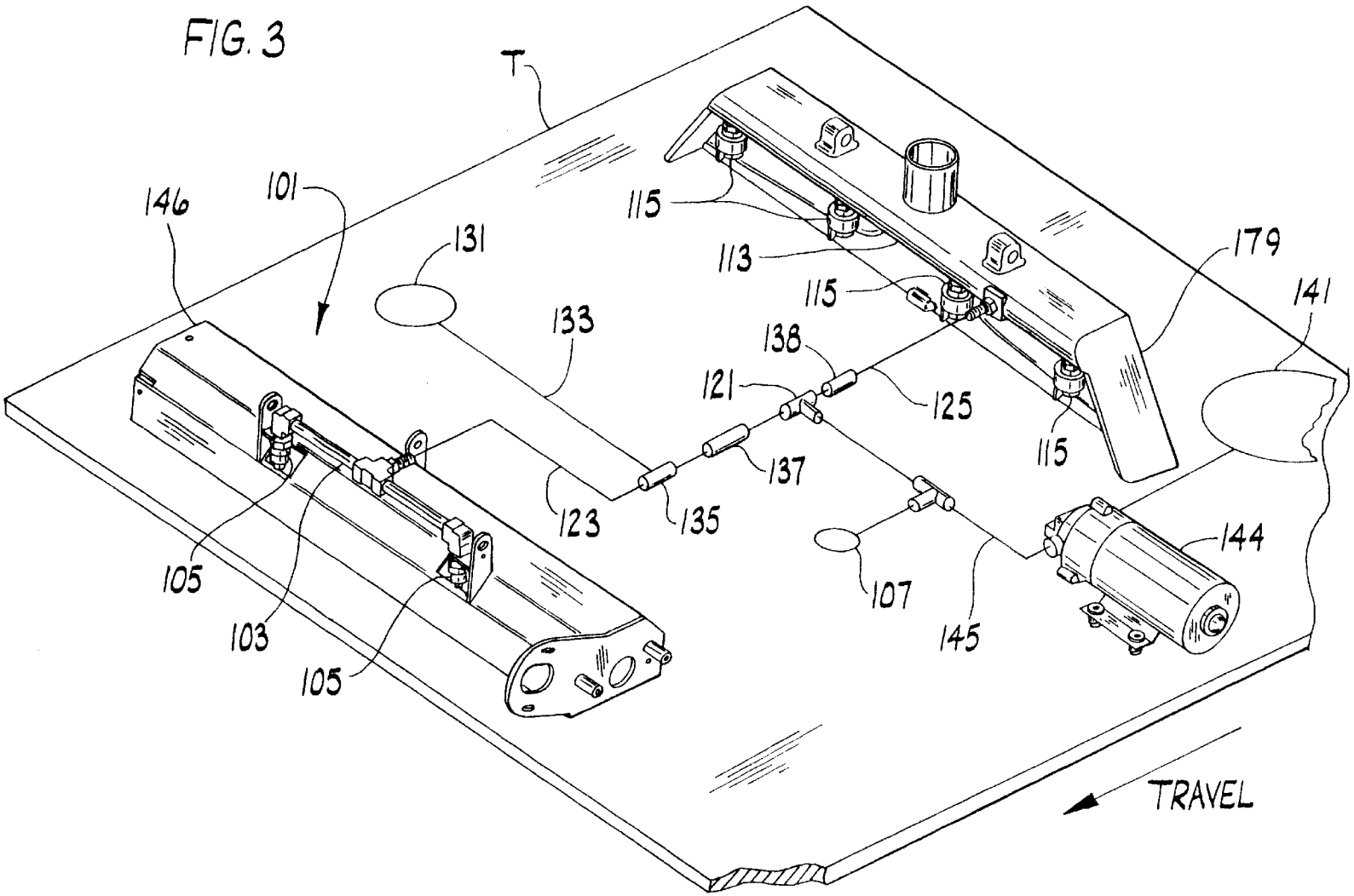
FIG. 3 is a schematic perspective of the cleaning system of FIG. 2.

Now referring to FIGS. 2 and 3, a cleaning system of the present invention for replacing the cleaning system of the conventional extraction machine 21 described above is generally indicated at 101. For purposes of illustrating and describing the new cleaning system 101, the various components of the cleaning system are shown separated from the extraction machine 21 and instead mounted on a test fixture T used for testing operation of the cleaning system. The cleaning system is described herein in accordance with a forward direction of travel of the extraction machine as indicated by the direction line in FIG. 2. As an example, the forward direction of travel of the extraction machine 21 of FIG. 1 in order to clean a carpet would be movement toward the rear of the machine (i.e., toward the left as viewed in FIG. 1).

The cleaning system 101 is similar to that of the conventional extraction machine 21 described above in that it includes a solution tank 141, pump 144, feed line 145, brush housing 146, brush (not shown but similar to brush 47 of FIG. 1) and vacuum shoe 179. However, the solution tank 141 of the present invention is filled only with water instead of a pre-mixed cleaning solution so that the pump 144 directs water under pressure from the solution tank through the fluid line 145. The water in the solution tank 141 broadly serves as a diluting solution for use in forming a cleaning solution within the cleaning system 101 during operation of the extraction machine as will be described later. A pressure gauge is disposed in the feed line 145 for measuring the fluid pressure of water pumped through the feed line. The fluid pressure in the feed line 145 is preferably at least about 45 psi. However, the fluid pressure in the feed line 145 may vary without departing from the scope of this invention. It is also understood that the pressure gauge 107 may be omitted from the cleaning system 101.

As shown in FIG. 3, the feed line 145 leading from the solution tank 141 has a T-connector 121 for directing water pumped through the feed line into a pair of delivery lines 123, 125. One delivery line 123 extends forward from the T-connector and is connected to a forward (with respect to the direction of travel) manifold 103 positioned above the brush housing 146 slightly forward of the brush 47. Spray nozzles 105 are connected to the manifold 103 and extend through the brush housing 146 in spaced relationship above the floor surface for dispensing cleaning solution from the manifold onto the carpet forward of the brush before the brush is moved over that segment of the carpet. In the preferred embodiment, there are two forward nozzles 105, although the number of nozzles may vary depending on the volume of cleaning solution to be dispensed onto the floor surface during operation of the extraction machine. It is also understood that the spray nozzles 105 may be disposed outside of the brush housing 146, or both inside and outside of the brush housing, without departing from the scope of this invention, as long as the nozzles are positioned forward of the brush such that fluid is dispensed onto an area of the carpet prior to the brush being moved over that area of the carpet. The delivery line 123, manifold 103 and nozzles 105 together define a cleaning solution dispenser for dispensing cleaning solution onto the floor surface being cleaned.

The other delivery line 125 extends rearward (with respect to the direction of travel) from the T-connector 121 and is connected to a rear manifold 113 positioned slightly forward of the vacuum shoe 179 for delivering water from the feed line 145 to the rear manifold. Spray nozzles 115 are connected to the rear manifold 113 in spaced relationship above the floor surface for dispensing water (e.g., diluting solution) onto a segment of the carpet slightly forward of the vacuum shoe 179 before the vacuum shoe is moved over that segment of the carpet to suction dirty solution from the carpet. In the preferred embodiment, there are four rear nozzles 115, although the number of rear nozzles may vary depending on the volume of water to be dispensed from these nozzles. The delivery line 125, rear manifold 113 and nozzles 115 together broadly define a diluting solution dispenser for dispensing dilution solution (e.g., water) onto the floor surface being cleaned. It is understood that a third set of spray nozzles (not shown) and second vacuum shoe (not shown) may be added to the extraction machine rearward of the spray nozzles 115 and vacuum shoe 179 without departing from the scope of this invention.

A chemical container 131 is sized for carriage onboard the extraction machine and contains a chemical cleaning agent for cleaning the carpet. The cleaning agent may be soap or other cleaning composition and is preferably in a concentrated liquid form to minimize the size of the container carried by the extraction machine. The container 131 may be disposed within the main housing (e.g., the main housing 223 of the conventional extraction machine shown in FIG. 1) or carried by the machine external of the main housing by a suitable container holder (not shown) mounted on the extraction machine. A chemical delivery line 133 leads from the container 131 and is connected to the delivery line 123 extending forward from the T-connector 121 generally intermediate the T-connector and the forward manifold 103 by a conventional venturi injector 135 disposed in the forward extending delivery line. The venturi injector 135 permits fluid pressure in the forward extending delivery line 123 to draw the cleaning agent from the chemical container 131 through the chemical delivery line 133 and into the forward extending delivery line for admixture with the water in the delivery line. A cleaning solution is thus formed within the forward extending delivery line 123 for dispensing onto the carpet via the forward manifold 103 and spray nozzles 105.

The venturi injector 135 preferably includes a metering tip (not shown) in communication with the chemical delivery line to meter the flow rate of the chemical cleaning agent from the chemical container into the venturi injector. The metering tip is preferably releasably connected to the venturi injector 135 to permit metering tips having different sized metering orifices to be used depending on the desired flow rate of chemical cleaning agent. It is understood, however, that the venturi injector may include means other than a metering tip to control the flow rate of cleaning agent from the cleaning container, such as a metering screw or other suitable metering device, without departing from the scope of this invention. It is also contemplated that the means for metering the flow rate of chemical cleaning agent from the chemical container may be disposed external of the main housing of the extraction machine to permit adjustment of the flow rate by the operator during operation of the extraction machine. A one-way check valve 137, such as a solenoid operated valve, is disposed in the forward extending delivery line 123 intermediate the T-connector 121 and the venturi injector 135 to inhibit the flow of cleaning chemical into the rearward extending delivery line 125 (e.g., the diluting solution dispenser). The check valve 137 is closed when the cleaning system 101 is inoperative to prevent the flow of water to the forward spray nozzles 105. A second solenoid operated valve 138 is disposed in the rearward extending delivery line 125 downstream of the T-connector 121 to prevent the flow of water to the rear spray nozzles 115 when the cleaning system 101 is inoperative.

In operation, the pump 144 is operated to direct water from the solution tank 141 through the feed line 145. Upon reaching the T-connector 121, a volume of the water in the feed line 145 is directed into the forward extending delivery line 123 while the remaining volume of water is directed into the rearward extending delivery line 125. The volumetric flow of water from the feed line 145 to the forward and rearward extending delivery lines 123, 125 depends on the number of forward and rearward nozzles 105, 115 and the size of the nozzle openings. In the preferred embodiment, a greater volume of water is directed to the four rear nozzles 115 for rinsing the carpet. Water flowing through the forward extending delivery line 123 passes through the one-way check valve 137 and then the venturi injector 135, causing a substantial drop in pressure and increased flow velocity of the water through the injector.

The pressure differential between the upstream and downstream ends of the venturi injector 135 causes chemical cleaning agent in the chemical container to be drawn through the chemical delivery line 133 into the injector for admixture with water flowing through the injector to form a cleaning solution in the forward extending delivery line 123 downstream of the injector. The cleaning solution is directed through the forward manifold 103 and dispensed onto the carpet through the spray nozzles 105. Water flowing through the rearward extending delivery line 125 is directed into the rear manifold 113 and dispensed onto the carpet through the rear spray nozzles 115.

To clean a carpet, the extraction machine in which the present cleaning system 101 is incorporated, such as the conventional extraction machine 21 described above, is used in accordance with a method of the present invention for cleaning floor surfaces. More particularly, the extraction machine 21 is moved across the carpet in the direction of travel indicated in FIG. 2. Cleaning solution is dispensed from the forward spray nozzles 105 and the scrub brush works the cleaning solution into the carpet to lift dirt from the carpet. As the extraction machine is moved further in the direction of travel, water dispensed from the rear spray nozzles 115 rinses the segment of carpet worked by the scrub brush. Cleaning solution and dirt lifted from the carpet become suspended in the water, thereby forming a dirty solution. The vacuum shoe 179 then passes over the dirty solution and suctions dirty solution from the carpet and into the recovery tank of the extraction machine, leaving a cleaned carpet.

Figure 4:
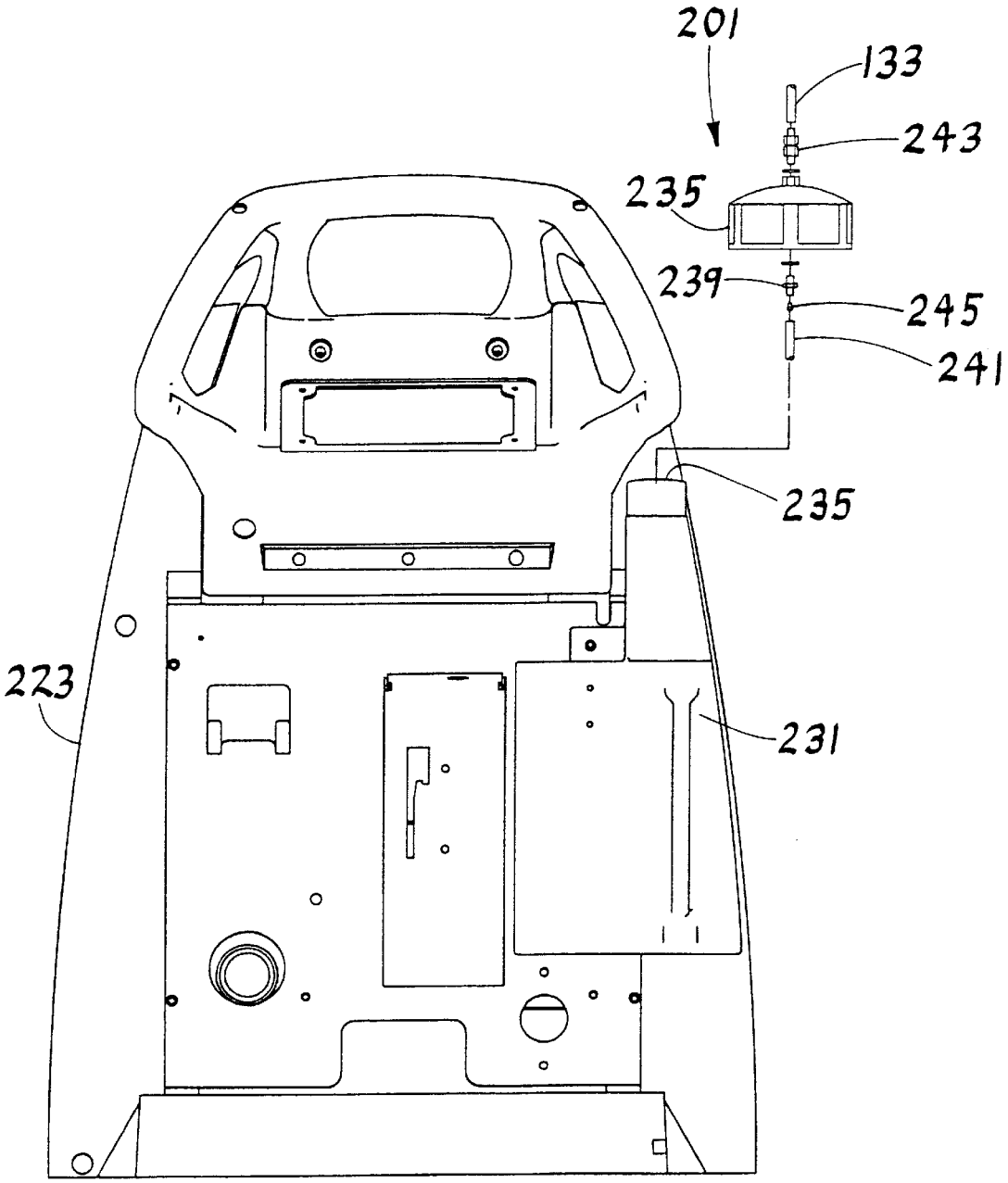
FIG. 4 is a schematic rear view of an extraction machine showing a portion of a second embodiment of a cleaning system of the present invention, including a container for holding chemical cleaning agent and a closure of the container shown exploded.
Figure 5:
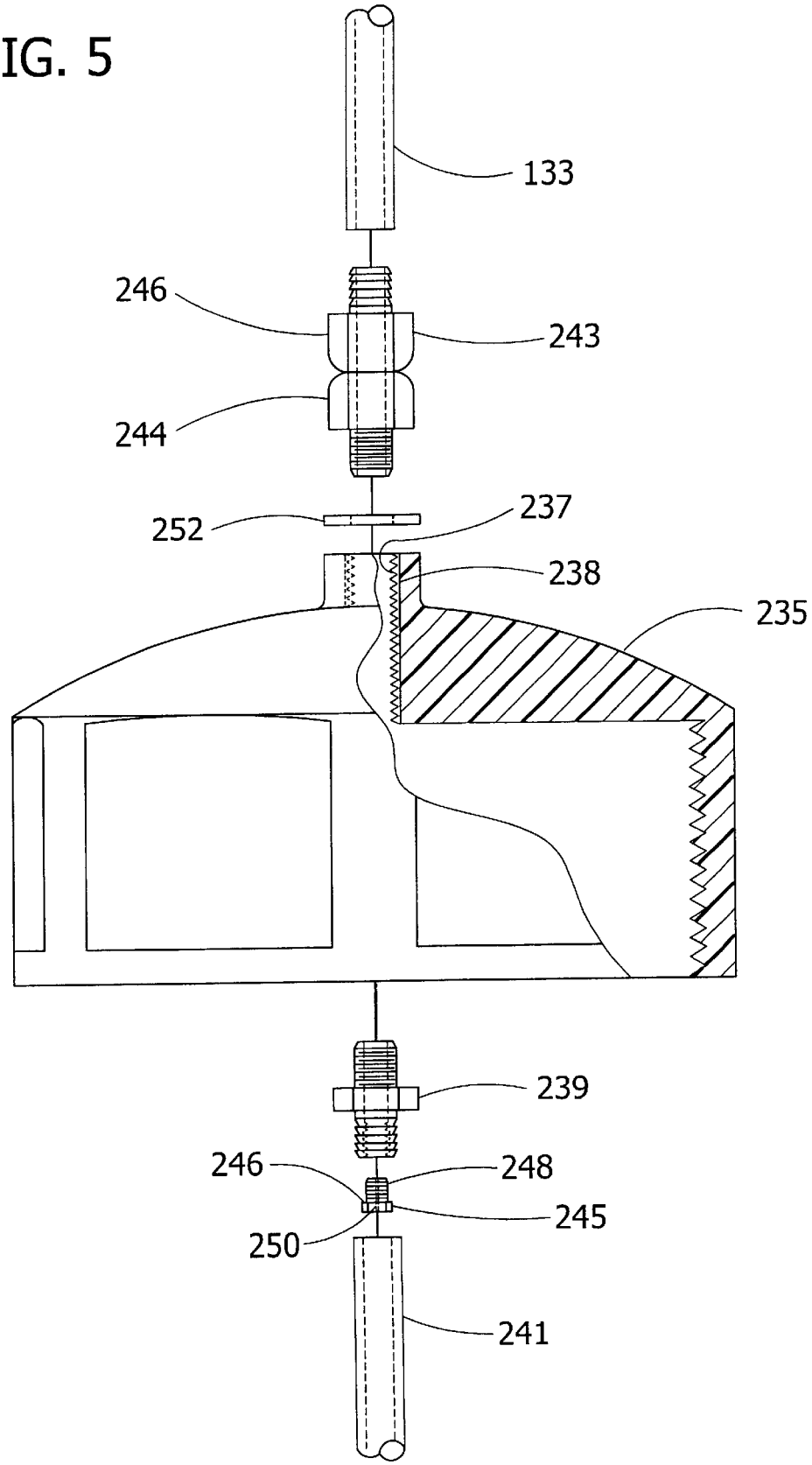
FIG. 5 is an enlarged schematic of the exploded portion of FIG. 4.

FIGS. 4 and 5 illustrate a liquid extraction machine incorporating a second embodiment of a cleaning system of the present invention (a portion of which is shown in FIG. 4 and generally indicated at 201). The illustrated embodiment of FIG. 4 is of one end of the extraction machine and shows a chemical container 231 of the cleaning system 201 sized for carriage onboard the extraction machine. The container 231 defines an interior space for containing the chemical cleaning agent. An opening (not shown) in the top of the container 231 provides access to the interior of the container for filling the container with chemical cleaning agent. A cap 235 (FIG. 4) having a central passage 237 (FIG. 5) therein is adapted for threaded (broadly, releasable) connection with the container 231 over the opening to provide a closure for the opening. It is understood that the cap may be releasably connected with the container 231 other than by threaded connection, such as by an interference fit or other suitable releasable connection, without departing from the scope of this invention.

The cap 235 is constructed of plastic and has a metal tube 238, such as of aluminum or steel, inserted therein and defining the central passage 237. The tube 238 is internally threaded for receiving a threaded hose barb connector 239 to releasably connect the hose barb connector with the cap 235 in fluid communication with the central passage 237. A suction line 241 is connected at one end to the hose barb connector 239 and extends down into the container 231. The other end of the suction line 241 is open to the interior space of the container 231 for fluid communication with the cleaning agent in the container.

In the illustrated embodiment, the container 231 is located at the rear of the machine so that the cap 235 is fully exposed and accessible exterior of the machine housing 223. However, it is contemplated that the container 231 may be partially or fully enclosed within the machine housing 223 without departing from the scope of this invention, as long as the container opening and cap 235 are accessible, such as by being accessible externally of the machine housing or, where the container is fully enclosed within the machine housing 223, by being located generally adjacent an access panel (not shown) that provides access to the container.

The metal tube 238 defining the central passage 237 of the cap 235 threadably receives a second threaded hose barb type connector 243 to releasably connect this connector to the top of the cap 235 in fluid communication with the central passage. The chemical delivery line 133 is connected to the second hose barb connector 243 and leads to the venturi injector 135 (FIG. 3) to provide fluid communication between the cleaning solution dispenser and the chemical cleaning agent in the container. This allows the venturi injector 135 to draw cleaning agent from the container 231 up through the suction line 241 within the container, through the hose barb connectors 239, 243, central passage 237 of the cap 235 and the chemical delivery line 133 and into the forward extending delivery line 123 (FIG. 3) for admixture with the water in the forward extending delivery line.

In the illustrated embodiment, the second hose barb connector 243 is a conventional swivel-type connector having one end 244 threadably connected to the cap 235 in the central passage 237 and an opposite end 246 rotatably connected to the other end for rotation relative thereto and relative to the cap. Thus it will be seen that the opposite end 246 of the connector 243, to which the chemical delivery line 133 is connected, is capable of rotation relative to the cap 235 about the central axis of the cap to permit rotation of the cap relative to the hose barb connector and the chemical delivery line 133 when threading the cap on or un-threading the cap from the container 231 without having to disconnect the chemical delivery line 133 from the cap. A sealing washer 252 is disposed between the hose barb connector 243 and the cap 235. The sealing washer 252 is preferably held in assembly with the hose barb connector 243, but may instead be independent therefrom. It is also contemplated that the hose barb connectors 239, 243, may be integrally formed with the cap 235 without departing from the scope of this invention.

In contrast with the cleaning system 101 of the first embodiment discussed above, wherein the venturi injector (135) includes a metering tip (not shown), the cleaning system of this second embodiment instead has a metering device 245 disposed in the suction line 241 extending from the cap 235 down into the container 231 to meter the flow of chemical cleaning agent from the container. The metering device 245 of the illustrated embodiment includes a flanged head 246, a tubular body 248 having an outer diameter sized smaller than the head, and a central passage 250 extending through the head and body. The central passage 250 is sized for metering the flow of chemical cleaning agent through the metering device 245. The hose barb connector 239 is internally threaded at its lower end and the body 248 of the metering device 245 has external threading for releasable, threaded connection with the hose barb connector. The flanged head 246 of the metering device 245 is adapted for engaging the lower end of the hose barb connector 239 upon threading of the body 248 into the connector to axially position the metering device therein and is sized for being received within the suction line 241 when the suction line is connected to the hose barb connector so that the suction line substantially encloses the metering device.

In this manner, the metering device 245 is held in assembly with the cap 235 so that the cap and metering device may be connected to and disconnected from the container 231 as a single unit. The suction line 241 is also held in assembly with the cap 235 by the hose barb connector 239. As a result, the metering device 245 is releasably installed in the suction line 241 to permit metering devices having different sized metering orifices to be easily interchanged, depending on the desired flow rate of chemical cleaning agent to the chemical delivery line 133. By locating the metering device 245 in the suction line 241 adjacent the cap 235, substantially upstream of the venturi injector 135, the metering device is readily accessible by removing the cap from the container (along with the hose barb connector 239 and suction line held in assembly with the cap), disconnecting the suction line from the hose barb connector and disconnecting the metering device from the connector. The metering device 245 provides a relatively precise, repeatable metering of the flow of chemical cleaning agent from the container 231.

It is understood that the metering device 245 may alternatively be located in the chemical delivery line 133 and be readily accessible for installation and removal therein, such as by being located adjacent the top of the cap 235 at the outer end of the central passage 237 where the chemical delivery line is connected to the hose barb connector 243, and remain within the scope of this invention. It is also understood that the metering device 245 may be releasably held in assembly with the cap 235 other than by a threaded connection, such as by an interference fit or other suitable connection, or the metering device may be releasably connected to the suction line 241 such that the metering device is held in assembly with the cap when the suction line is connected to the hose barb connector 239.

Figure 6:
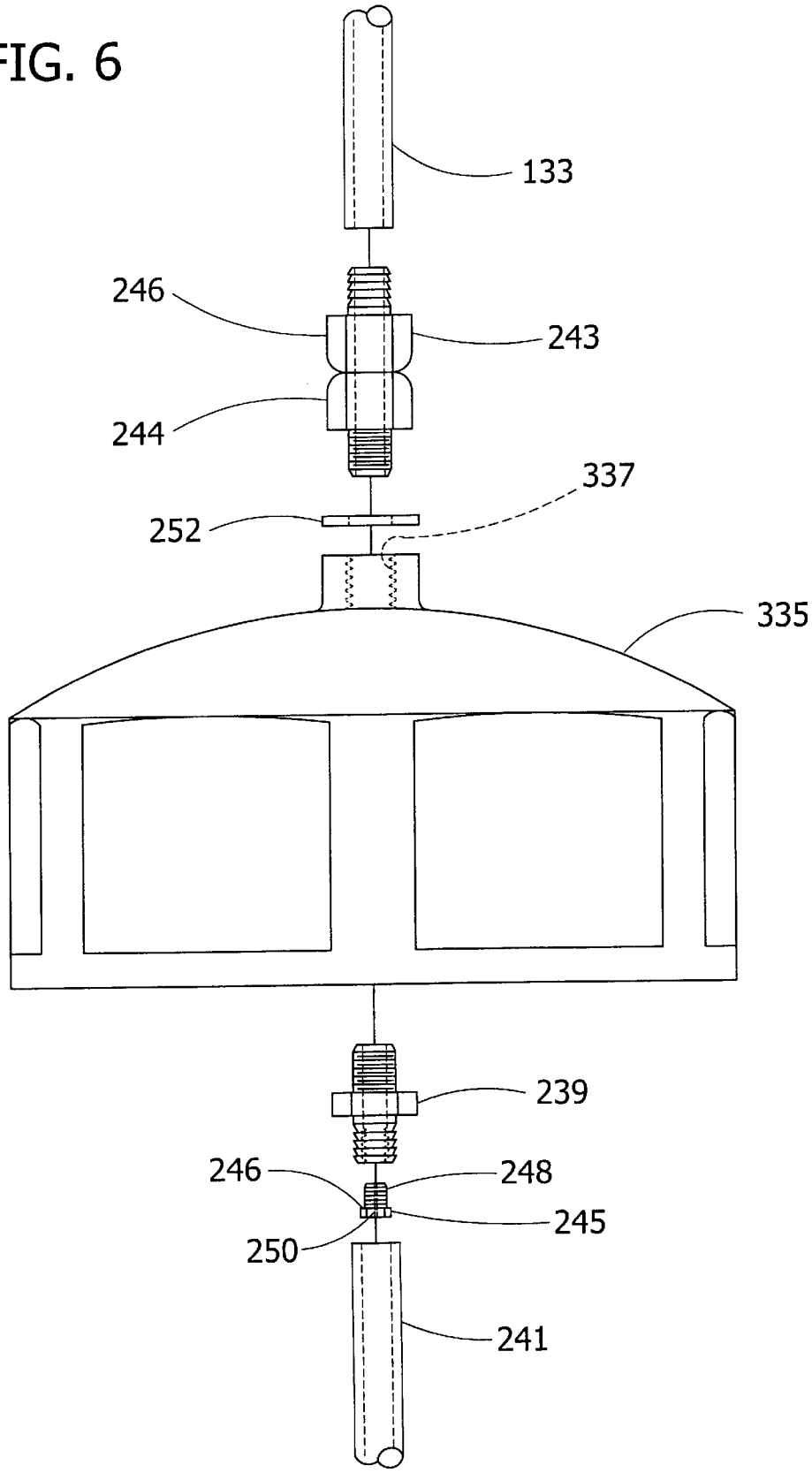
FIG. 6 is a view similar to FIG. 5 of an alternative closure of the container.

FIG. 6 illustrates an alternative embodiment of a cap 335 of the container 231 in which the cap is constructed of aluminum and has a central passage 337 so that the metal tube 238 of the cap 235 of FIG. 5 may be omitted. In all other respects, the cap 335 and related components shown in FIG. 6 are substantially identical to those shown in FIG. 5.

The cleaning system 101, 201 of the present invention is shown and described herein as being configured for incorporation into a conventional extraction machine such as that shown in FIG. 1. However, it is understood that the present cleaning system 101, 201 may be incorporated in various types and models of extraction machines and other floor surface treatment machines without departing from the scope of this invention.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. An extraction machine for cleaning a floor surface, the extraction machine being movable relative to the floor surface in a desired direction of travel to clean the floor surface, said extraction machine comprising:

a cleaning solution dispenser capable of dispensing a chemical cleaning agent onto the surface being cleaned;

a container carried onboard the extraction machine and defining an interior space for holding a supply of said chemical cleaning agent, the container having an opening and a closure for the opening, the closure having a passage extending therethrough in fluid communication with the interior space of the container;

a chemical delivery line providing fluid communication between the passage of the container closure and the cleaning solution dispenser for delivering chemical cleaning agent from said interior space of the container to said cleaning solution dispenser; and a metering device generally adjacent the container closure in fluid communication with the passage of said closure for metering the flow of chemical cleaning agent from said container.

2. An extraction machine as set forth in claim 1 wherein the metering device is held in assembly with the closure in fluid communication with the passage of the container closure.

3. An extraction machine as set forth in claim 2 wherein the closure is releasably connected to the container, the metering device being held in assembly with the closure such that the closure and the metering device are removable from the container as a single unit.

4. An extraction machine as set forth claim 2 wherein the metering device is releasably connected to the closure.

5. An extraction machine as set forth in claim 3 wherein the chemical delivery line is releasably connected to the container closure in fluid communication with the passage of said closure for selective removal of the chemical delivery line from the container.

6. An extraction machine as set forth in claim 3 further comprising a suction line disposed in the interior space of the container in fluid communication with the passage of the container closure for directing chemical cleaning agent to flow from the interior space of the container through said passage to the chemical delivery line, the suction line being releasably connected to the closure for removing the suction line from the container along with said closure.

7. An extraction machine as set forth in claim 6 wherein the metering device is disposed in said suction line within said interior space of the container for metering the flow of chemical cleaning agent from the container.

8. An extraction machine as set forth in claim 7 wherein the metering device is disposed in the suction line generally at the connection between the suction line and the closure.

9. An extraction machine as set forth in claim 8 wherein the container closure comprises a removable cap and a hose connector connected to the cap and defining an upstream end of the passage of said closure, the metering device being adapted for releasable connection with the hose connector, the suction line being adapted for releasable connection with the hose connector and being sized relative to the metering device such that the metering device is at least partially received in the suction line when the suction line is connected to the hose connector.

10. An extraction machine as set forth in claim 9 wherein the metering device comprises a tubular body adapted for releasable connection with the hose connector, a flanged head on the body adapted for axially positioning the metering device relative to the hose connector, and a central passage through the head and the body for metering the flow of chemical cleaning agent through the metering device, said suction line being sized for receiving the flanged head of the metering device therein when the suction line is connected to the hose connector.

11. An extraction machine as set forth in claim 1 further comprising a machine housing, the metering device being disposed generally exterior of the machine housing.

12. An extraction machine as set forth in claim 11 wherein the container is disposed at least partially within the housing.

13. An extraction machine for cleaning a floor surface, the extraction machine being movable relative to the floor surface in a desired direction of travel to clean the floor surface, said extraction machine comprising:

a cleaning solution dispenser capable of dispensing a chemical cleaning agent onto the surface being cleaned;

a source of chemical cleaning agent carried onboard the extraction machine;

a chemical delivery line providing fluid communication between the source of chemical cleaning agent and the cleaning solution dispenser for delivering chemical cleaning agent from said source of chemical cleaning agent to said cleaning solution dispenser;

a source of diluting solution for delivering diluting solution to said cleaning solution dispenser, said source of diluting solution being in fluid communication with the chemical delivery line to permit admixture of the chemical cleaning agent and the diluting solution during flow to cleaning solution dispenser to form a cleaning solution for dispensing onto the floor surface by the cleaning solution dispenser;

an injection device in fluid communication with the source of chemical cleaning agent for injecting chemical cleaning agent from the source of chemical cleaning agent into admixing relationship with the diluting solution to facilitate admixture of the cleaning agent with the diluting solution; and a metering device for metering the flow of chemical cleaning agent from the source of cleaning agent, said metering device being disposed substantially upstream of the injection device.

* * * * *